US011597006B2

(12) United States Patent
Yanagiya et al.

(10) Patent No.: US 11,597,006 B2
(45) Date of Patent: Mar. 7, 2023

(54) INJECTION APPARATUS

(71) Applicant: THE JAPAN STEEL WORKS, LTD., Tokyo (JP)

(72) Inventors: Takehiko Yanagiya, Tokyo (JP); Yutaka Nakagawa, Tokyo (JP); Yusuke Sugimori, Tokyo (JP)

(73) Assignee: THE JAPAN STEEL WORKS, LTD., Tokyo (JP)

( * ) Notice: Subject to any disclaimer, the term of this patent is extended or adjusted under 35 U.S.C. 154(b) by 0 days.

(21) Appl. No.: 17/700,464

(22) Filed: Mar. 21, 2022

(65) Prior Publication Data

US 2022/0324015 A1 Oct. 13, 2022

(30) Foreign Application Priority Data

Apr. 13, 2021 (JP) ..... JP2021-067515

(51) Int. Cl.
*B22D 17/20* (2006.01)

(52) U.S. Cl.
CPC ..... *B22D 17/203* (2013.01)

(58) Field of Classification Search
CPC ..... B22D 17/203; B22D 17/2069; B22D 17/2061; B29C 45/53; B29C 45/532; B29C 45/57; B29C 45/575
See application file for complete search history.

(56) References Cited

FOREIGN PATENT DOCUMENTS

JP 2007-216285 A 8/2007

*Primary Examiner* — Kevin P Kerns
*Assistant Examiner* — Steven S Ha
(74) *Attorney, Agent, or Firm* — SGPatents PLLC

(57) ABSTRACT

An injection piston can be driven along an axial direction of a heating barrel. The injection piston is connected to a screw and drives the screw along the axial direction. An injection hydraulic cylinder drives the injection piston in the axial direction by pressure of hydraulic oil. Inside of the injection hydraulic cylinder being partitioned into a first chamber and a second chamber. An oil discharge port is provided in the injection hydraulic cylinder and discharges the hydraulic oil from the second chamber. A first valve is inserted in a path for discharging the hydraulic oil discharged from the second chamber. A second valve opens when the pressure of the provided oil is higher than a first threshold value. The first valve closes when the pressure of the hydraulic oil supplied through the second valve is applied to the first valve.

4 Claims, 8 Drawing Sheets

INJECTION APPARATUS

INCORPORATION BY REFERENCE

This application is based upon and claims the benefit of priority from Japanese patent application No. 2021-067515, filed on Apr. 13, 2021, the disclosure of which is incorporated herein in its entirety by reference.

BACKGROUND

The present disclosure relates to an injection apparatus and, for example, relates to an injection apparatus of a metal injection molding machine for performing injection molding of metal such as magnesium alloy and aluminum alloy.

Metal injection molding machines are widely used to form products by filling a cavity in a mold with a molten metal material. As an example of injection molding used in such a metal injection molding machine, it has been proposed that an injection apparatus of a metal injection molding machine having a configuration in which a speed of an injection piston is rapidly reduced to shift a process from an injection process to a pressure holding process (Japanese Unexamined Patent Application Publication No. 2007-216285).

In this injection apparatus, an oil discharge port having a large opening and an oil discharge port having a small opening are provided in a rear chamber, and when the injection piston advances to a pressure holding switching position, the oil discharge port having the large opening is blocked by the injection piston. As a result, the discharge amount of the hydraulic oil is greatly reduced, so that the injection piston is braked rapidly, and the discharge of the hydraulic oil during the pressure holding process can be performed through the oil discharge port having the small opening.

SUMMARY

In the injection apparatus described above, although the piston can be rapidly decelerated, the pressure of the molten material decreases rapidly. Therefore, there is a problem that sufficient pressure cannot be kept in the pressure holding process after the filling of the molten material has been completed.

Other challenges and novel features will become apparent from the description herein and the accompanying drawings.

An injection apparatus according to an embodiment is an injection apparatus including: an injection piston configured to be capable of being driven along an axial direction of a heating barrel, the injection piston being connected to a screw provided in the heating barrel to be rotatable and driving the screw along the axial direction; an injection hydraulic cylinder configured to drive the injection piston housed therein in the axial direction by pressure of hydraulic oil, inside of the injection hydraulic cylinder being partitioned into a first chamber in which pressure oil is supplied to drive the injection piston and a second chamber from which hydraulic oil is discharged; an oil discharge port provided in the injection hydraulic cylinder and configured to discharge the hydraulic oil from the second chamber; a first valve inserted in a path for discharging the hydraulic oil discharged from the second chamber through the oil discharge port; and a second valve configured to be supplied with a part of the hydraulic oil supplied to the first chamber and to open when the pressure of the provided oil is higher than a first threshold value, in which the first valve is configured to close when the pressure of the hydraulic oil supplied through the second valve is applied to the first valve.

According to an embodiment, it is possible to provide an injection apparatus of a metal injection molding machine capable of advantageously protecting an injection piston.

The above and other objects, features and advantages of the present disclosure will become more fully understood from the detailed description given hereinbelow and the accompanying drawings which are given by way of illustration only, and that are not to be considered as limiting the present disclosure.

DESCRIPTION OF EMBODIMENTS

Figure 1:
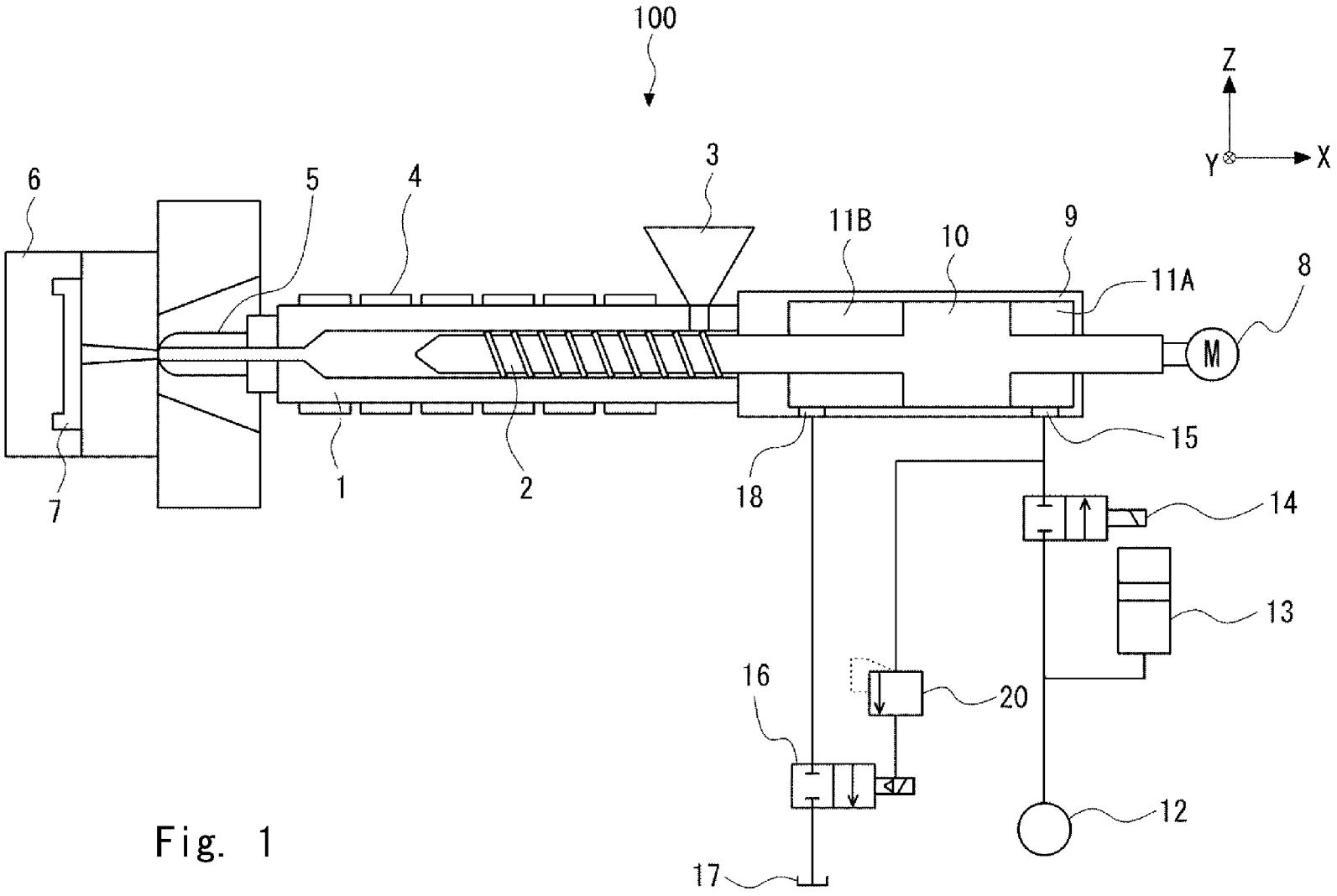
FIG. 1 shows a schematic configuration of an injection apparatus of a metal injection molding machine according to a first embodiment.

Hereinafter, embodiments of the present disclosure will be described with reference to the drawings. However, the present disclosure is not limited to the following embodiments. In order to clarify the description, the following description and drawings are appropriately simplified. In addition, the same elements are denoted by the same reference numerals, and the redundant description will be omitted.

Hereinafter, in FIGS. 1 to 3 and 6, a direction from a rear chamber to a front chamber along a central axis of an injection piston 10 is defined as an X-direction, and the vertical direction from the bottom to the top of the paper of the drawing is defined as a Z-direction. A normal direction that is perpendicular to the X-direction and the Z-direction and extends from the front to the back of the paper is defined as a Y-direction.

First Embodiment

Figure 6:
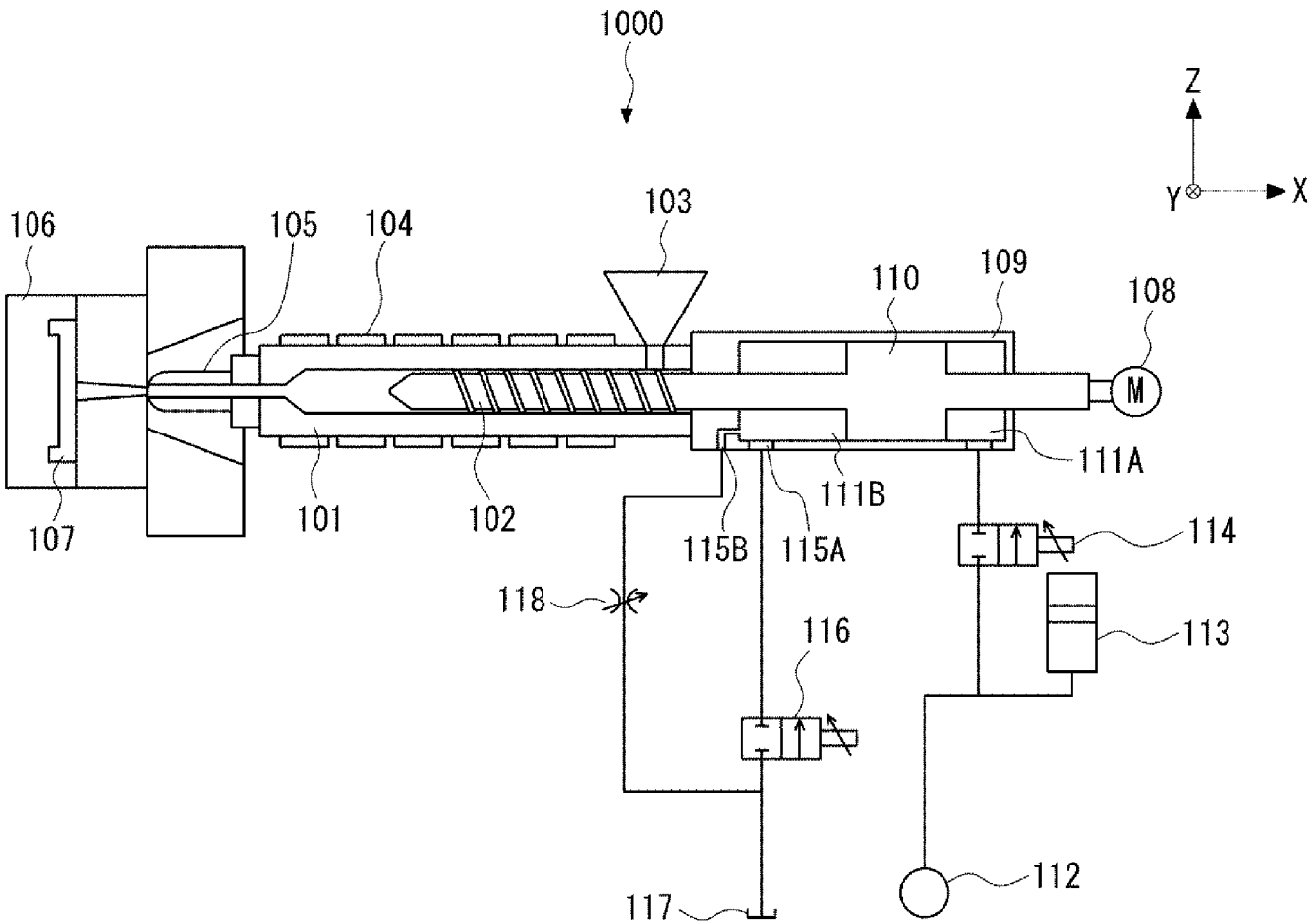
Fig. 6 Prior Art
FIG. 6 is a diagram showing a schematic configuration of a general injection apparatus of a general metal injection molding machine.

As a premise for understanding an injection apparatus of a metal injection molding machine according to the present embodiment, a general injection apparatus of a metal injection molding machine according to Japanese Unexamined Patent Application Publication No. 2007-216285 will be described. FIG. 6 shows a schematic configuration of a general injection apparatus 100 of a metal injection molding machine. The injection apparatus 100 includes a heating barrel 101 and a screw 102 provided inside the heating barrel 101 to be freely driven in the axial direction and the rotational direction of the heating barrel 101. Molding material is charged from a hopper 103 into the heating barrel 101, and the charged material is molten by frictional heat and shear heat generated due to rotation of the screw 102 and heat applied from a heater 104 disposed on the outer periphery of the heating barrel 101. The molten material is kneaded by the rotation of the screw 102 and sent to the front of the heating barrel 101. A nozzle 105 is attached to the tip of the heating barrel 101. When the material is injected, the molten molding material held at the tip of the heating barrel 101 is injected through the nozzle 105 into a cavity 107 of a mold 106 that is closed.

The screw 102 is rotationally driven by a motor 108 and axially driven by an injection piston 110 provided inside an injection hydraulic cylinder 109.

The injection hydraulic cylinder 109 is partitioned into two chambers by the injection piston 110, and a rear chamber 111B is provided on a −X side and a front chamber 111A is provided on a +X side. Pressure oil accumulated by a hydraulic pump 112 to an accumulator 113 is supplied to the front chamber 111A through a flow control valve 114. The rear chamber 111B is provided with a first oil discharge port 115A completely or mostly blocked by the injection piston 110 at a desired holding pressure switching position of the injection piston 110, and a second oil discharge port 115B not blocked by the injection piston 110 even at the most forward position of the injection piston 110. The first oil discharge port 115A is formed on the side face of the injection hydraulic cylinder 109, and the second oil discharge port 115B is formed on the end face of the injection hydraulic cylinder 109.

The first oil discharge port 115A is connected to an oil tank 117 through a flow control valve 116, and has an opening area large enough to discharge the hydraulic oil stored in the rear chamber 111B to the oil tank 117 in an injection process. The second oil discharge port 115B is connected through a flow control valve 118 to the oil tank 117, and the hydraulic oil in the rear chamber 111B is discharged into the oil tank 117 through the second oil discharge port 115B in a pressure holding process. As long as the hydraulic oil can be flowed at a flow rate in the pressure holding process and at a flow rate for retreating the injection piston 110 (for moving in the +X-direction) in a measuring process through the second oil discharge port 115B, the opening area of the second oil discharge port 115B may be smaller than that of the first oil discharge port 115A.

The injection molding mainly includes the measuring process, the injection process, and the pressure holding process. In the measuring process, solid molding material is fed from the hopper 103 into the heating barrel 101, and the screw 102 is driven rearward in the axial direction (+X-direction) by the injection hydraulic cylinder 109 while being rotationally driven by the motor 108. Thus, the material is molten and sent forward (−X-direction) inside the heating barrel 101 to measure the material. In the injection process, when the measured value reaches a predetermined value, the screw 102 is driven forward in the axial direction (−X-direction) by supplying the pressure oil to the injection hydraulic cylinder 109, and the measured molten material is injected from the nozzle 105 into the cavity 107 of the mold 106. The pressure holding process is a process of applying pressure to the material in the mold 106 through the material remaining in the heating barrel 101 to compensate for shrinkage caused by cooling of the material after the injection of the material has been completed. These steps allow the material to be molded into a desired shape of the cavity 107.

In the above injection apparatus, although the piston can be rapidly decelerated, the molten material pressure decreases rapidly, and thereby there is a problem in which sufficient pressure of the molten material cannot be kept in the pressure holding process.

Figure 7A:
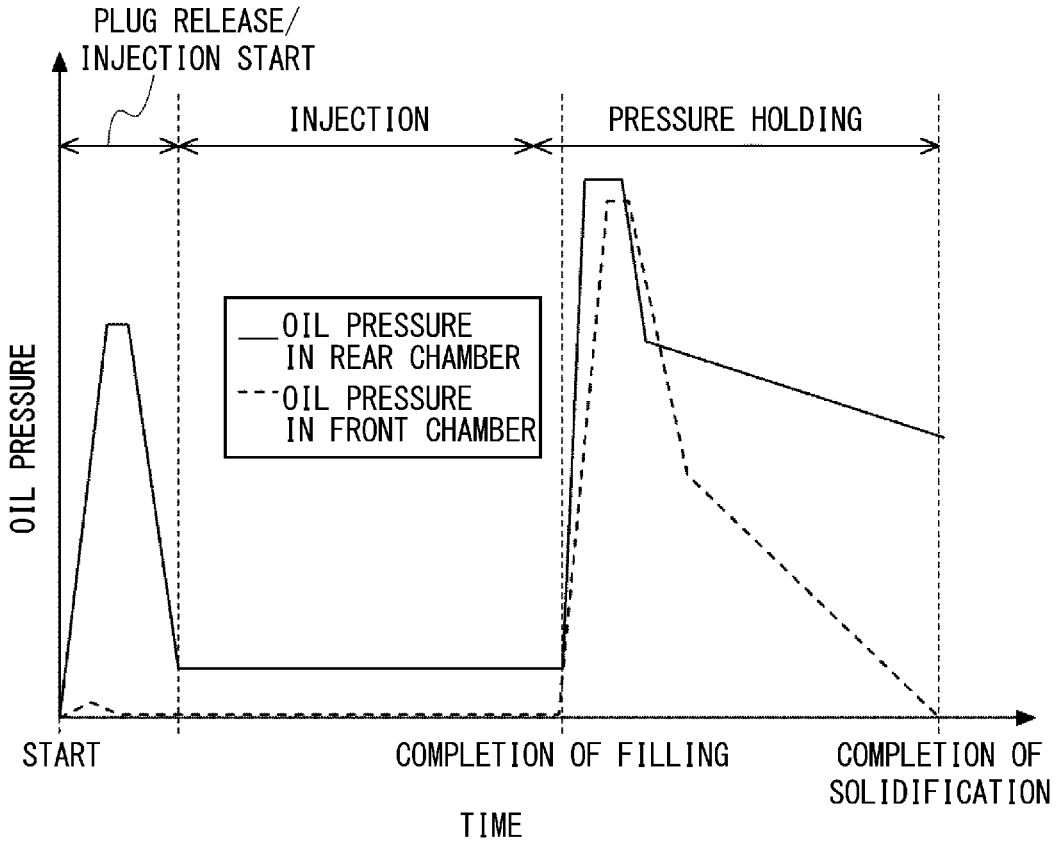
FIG. 7A shows oil pressure in the general injection apparatus.
Figure 7B:
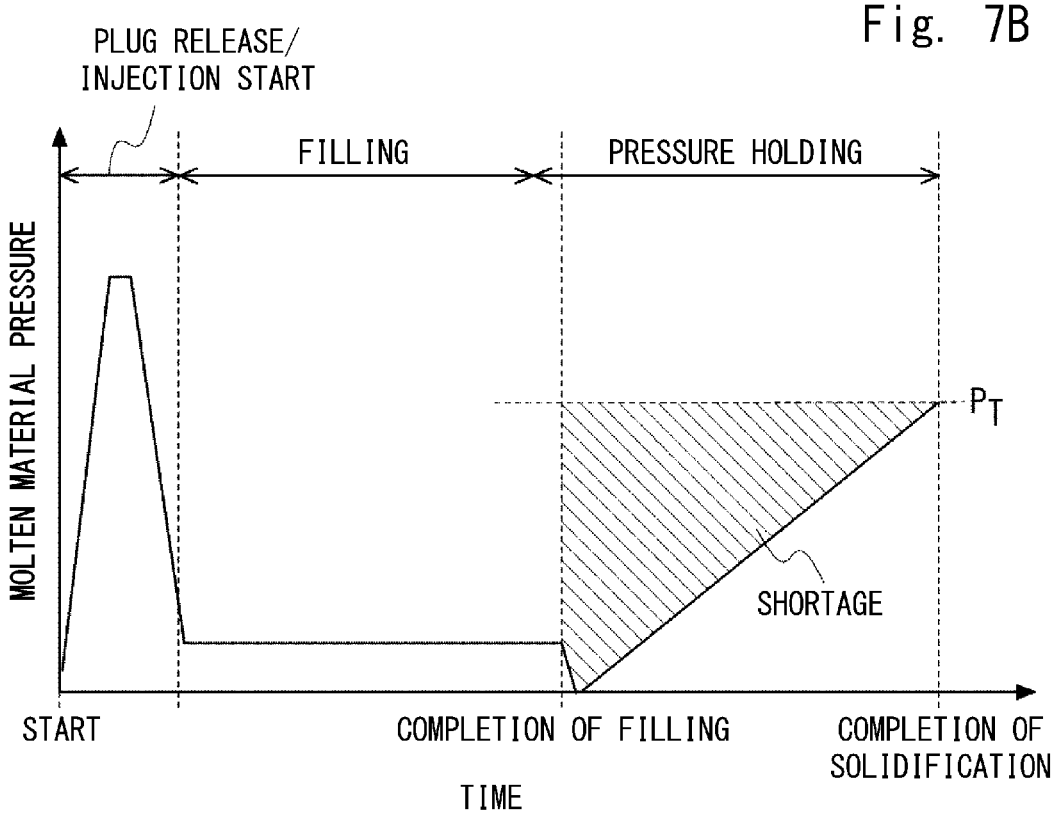
FIG. 7B shows molten material pressure in the general injection apparatus.

FIGS. 7A and 7B show oil pressure and molten material pressure in the injection apparatus 100, respectively. As the process is started, the pressure oil is supplied to the front chamber 111A and the oil pressure rapidly increase. After that, the oil pressure decreases due to release of a cold plug, and the injection piston 110 starts to advance. Then, as the filling of the molten material into the mold is completed, the oil pressures in the front chamber 111A and the rear chamber 111B rapidly increase due to return action. At this time, the oil pressure rapidly increases due to the inertia of the injection piston 110 and the hydraulic oil supplied to the front chamber 111A, and thereby a peak is caused in the oil pressure. Then the effect of the inertia is relieved, the oil pressure is rapidly decreased and, thereafter, gently decreases until solidification is completed.

The molten material pressure P at that time is obtained by the following expression where the oil pressure in the front chamber 111A is $P_{111A}$, the area of the surface of the injection piston 110 on the front chamber 111A side to which the oil pressure is applied is $S_{111A}$, the oil pressure in the rear chamber 111B is $P_{111B}$, the area of the surface of the injection piston 110 on the rear chamber 111B side to which the oil pressure is applied is $S_{111B}$, and the area of the cross-section of the cylinder is Sc.

$$P=(P_{111A}*S_{111A}-P_{111B}*S_{111B})/Sc$$

Therefore, the molten material pressure after the filling decreases down to zero and, after that, gently increases according to a difference between the oil pressure in the rear chamber 111B and the oil pressure in the front chamber 111A.

However, during the pressure holding process, there is a pressure to be kept (referred to as a target pressure hereinafter) to mold the material in the cavity 107 of the mold into a desired shape. In this case, since the molten material pressure becomes zero when the pressure holding process is started after the filling of the molten material is completed, the molten material pressure becomes significantly lower than the target pressure. Thereafter, although the molten material pressure increases, the molten material pressure remains lower than the target pressure. Therefore, in the above-described injection apparatus 100, a problem that sufficient molten material pressure, that is, the pressure in the pressure holding process cannot be secured is caused.

Figure 8:
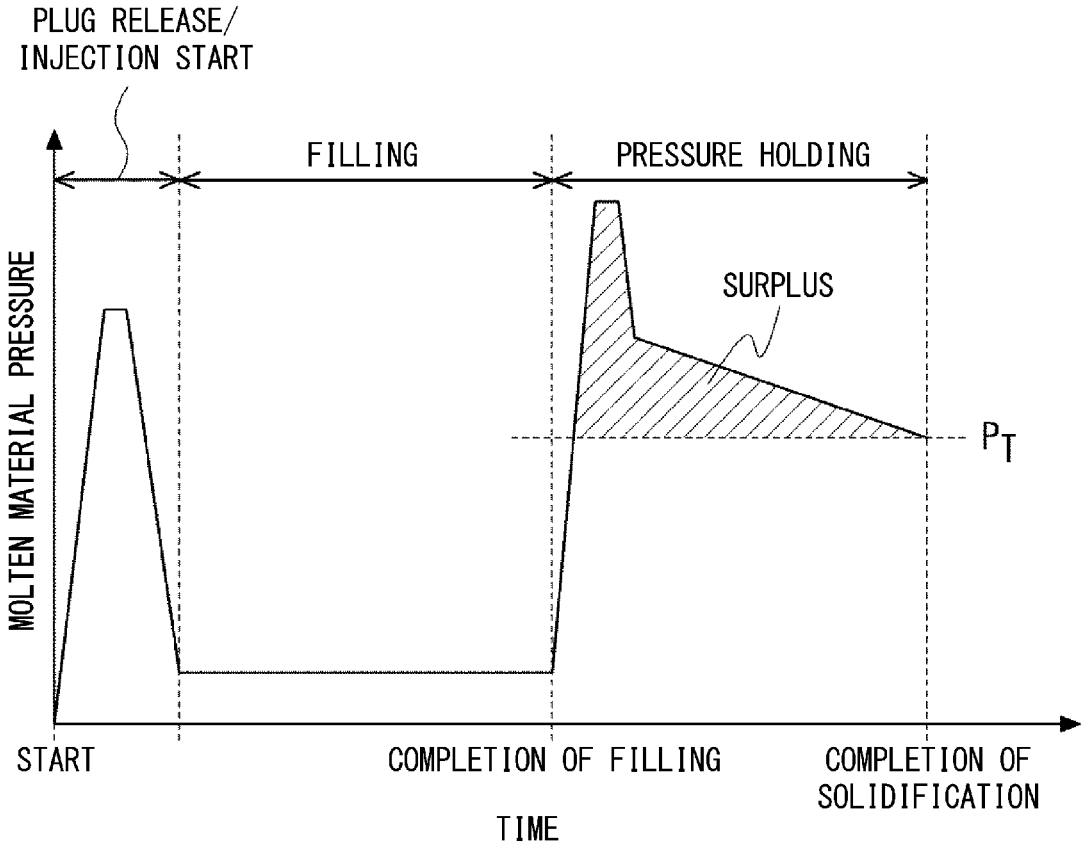
FIG. 8 shows molten material pressure in another general injection apparatus.

On the other hand, in other general injection apparatuses that do not perform rapid deceleration of the injection piston as the injection apparatus 100 described above, a problem that the pressure in the pressure holding process increases excessively is caused. FIG. 8 shows molten material pressure in another general injection apparatus. In this example, the discharge of the hydraulic oil in the rear chamber continues even after the completion of the filling, and the oil pressure in the rear chamber is kept low in the pressure holding process. As a result, the molten material pressure increases rapidly with the start of the pressure holding process, and the molten material pressure is kept at high pressure even after the peak. In this case, since the time when the molten material pressure becomes excessively higher than the target pressure is long, problems such as generation of burrs of the product, ejection of the molten material from the mold, and increase of load to the mold occur.

Hereinafter, in the present embodiment, an injection apparatus of a metal injection molding machine configured to adjust the pressure in the pressure holding process will be described.

An injection apparatus according to a first embodiment will be described. FIG. 1 shows a schematic configuration of an injection apparatus of a metal injection molding machine according to the first embodiment. An injection apparatus 100 shown in FIG. 1 includes a heating barrel 1 and a screw 2 provided inside the heating barrel 1 to be freely driven in the axial direction and the rotational direction of the heating barrel 1. Molding material is charged from a hopper 3 into the heating barrel 1, and the charged material is molten by frictional heat and shear heat generated due to rotation of the screw 2 and heat applied from a heater 4 disposed on the outer periphery of the heating barrel 1. The molten material is kneaded by the rotation of the screw 2 and sent to the front of the heating barrel 1 (−X-direction). A nozzle 5 is attached to the tip of the heating barrel 1. When the material is injected, the molten molding material held at the tip of the heating barrel 1 is injected through the nozzle 5 into a cavity 7 of a mold 6 that is closed.

The screw 2 is rotationally driven by a motor 8 and axially driven by an injection piston 10 provided inside an injection hydraulic cylinder 9.

The injection hydraulic cylinder 9 is partitioned into two chambers by the injection piston 10, and a front chamber 11A (also referred to as a first chamber) is provided on the −X side and a rear chamber 11B (also referred to as a second chamber) is provided on the +X side. An oil supply port 15 is provided in the front chamber 11A. The pressure oil accumulated to the accumulator 13 by a hydraulic pump 12 is supplied to the front chamber 11A through the oil supply port 15 after the flow rate of the oil is controlled by a flow control valve 14. In the present embodiment, to supply the pressure oil to the front chamber 11A, it is desirable that the flow control valve 14 is configured as, for example, a servo valve, more specifically, as a cartridge servo valve.

Figure 2:
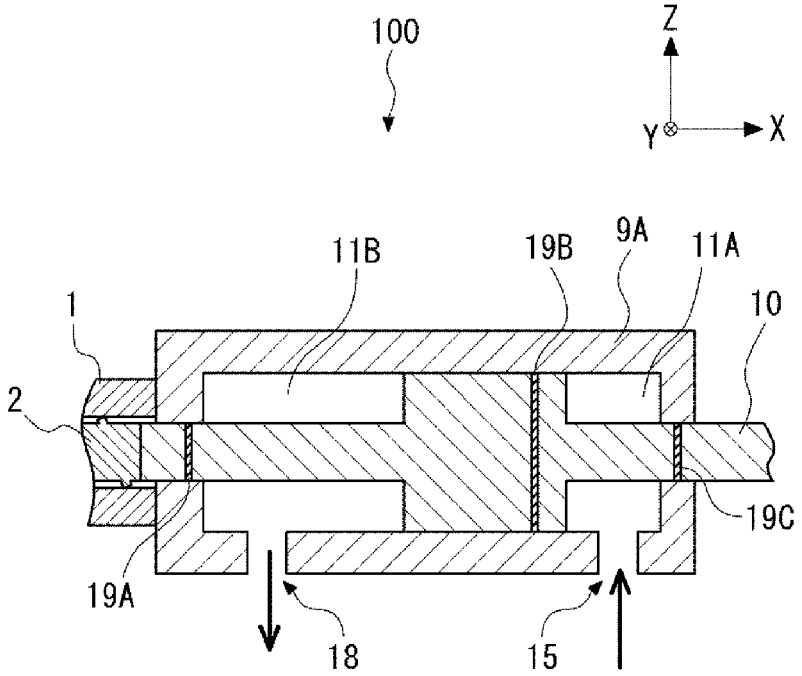
FIG. 2 is an enlarged view of the injection apparatus according to the first embodiment.

The configuration of the injection apparatus 100 will be described below. FIG. 2 is an enlarged diagram of the injection apparatus 100. In the rear chamber 11B, an oil discharge port 18 is provided at a position not to be completely blocked by the injection piston 10 when the injection piston 10 is at the desired holding pressure switching position.

In FIG. 2, sealing members 19A to 19C such as guide rings and oil seals are provided to prevent leakage of hydraulic oil. The sealing member 19A is disposed to seal between the inner surface of the opening provided on the −X side of a housing 9A of the injection hydraulic cylinder 9 and a shaft connected to the injection piston 10. The sealing member 19B is disposed to seal between the inner surface of the housing 9A and the injection piston 10. The sealing member 19C is disposed to seal between the inner surface of the opening on the +X side of the housing 9A and the shaft connected to the injection piston 10.

In the rear chamber 11B, the oil discharge port 18 is provided to penetrate the injection hydraulic cylinder 9 in the radial direction. The oil discharge port 18 is connected through a flow control valve 16 (also referred to as a first valve) to an oil tank 17, and has an opening area enough to the hydraulic oil in the front chamber 11B is discharged to the oil tank 17 in the injection process described later. In the present embodiment, the flow control valve 16 is configured as an external pilot valve, and a part of the pressure oil supplied to the front chamber 11A is supplied as the pressure oil for operating the flow control valve 16 (also referred to as an operating pressure oil) through a relief valve 20 (also referred to as a second valve) described later.

In the present configuration, the relief valve 20 is provided to prevent excessive increase in brake pressure. A part of the pressure oil supplied to the front chamber 11A is supplied to the relief valve 20.

The relief valve 20 is configured as an internal pilot valve that opens when the pressure of the supplied pressure oil becomes greater than a predetermined value.

When the relief valve 20 is opened, a part of the pressure oil supplied to the front chamber 11A is supplied to the flow control valve 16 as the operating pressure oil. In the present configuration, the flow control valve 16 is configured as an external pilot valve that opens when the pressure of the supplied operating pressure oil is equal to or greater than a predetermined value and closes when the pressure is lower than the predetermined value.

Figure 3:
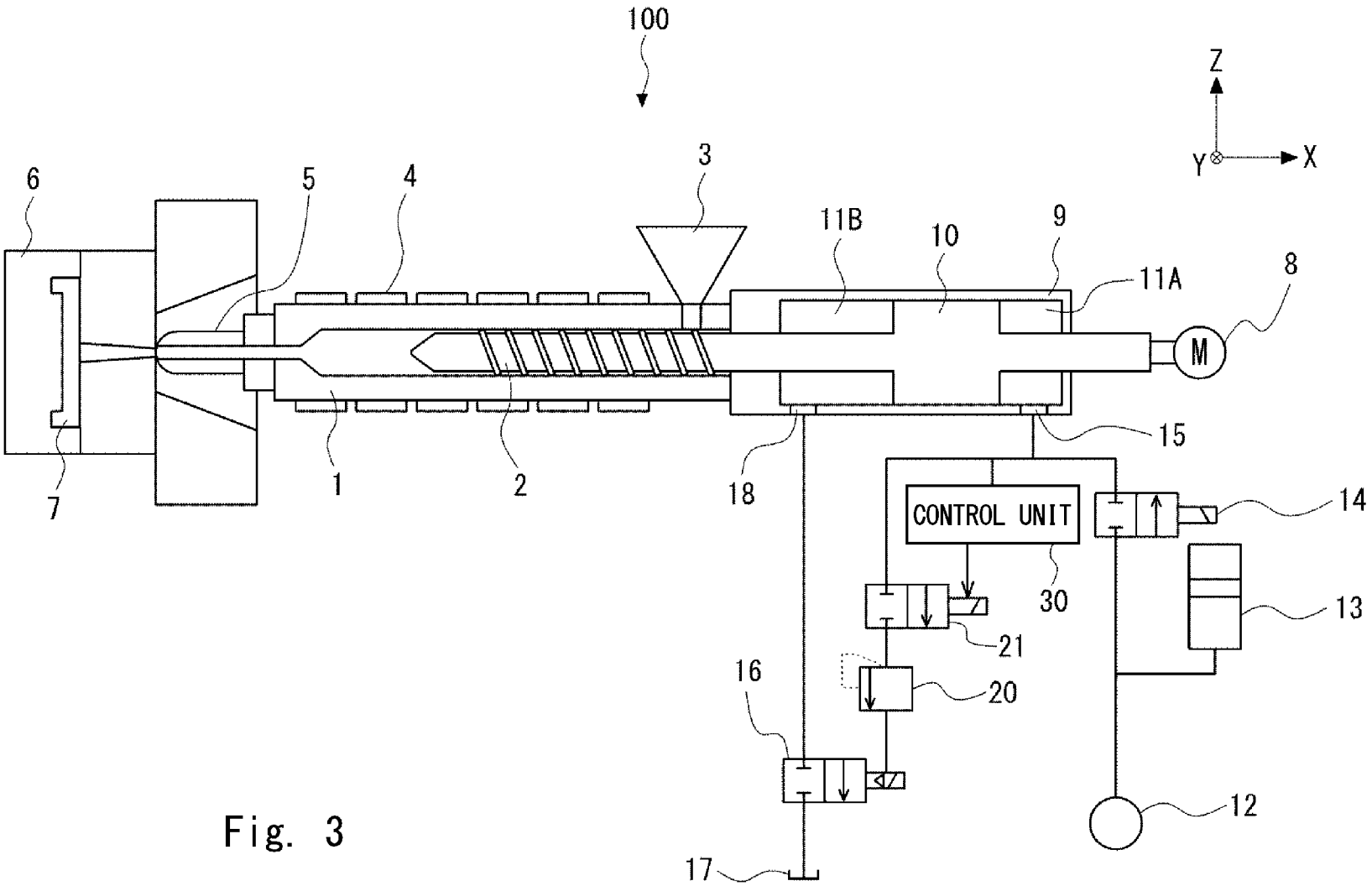
FIG. 3 shows a more detailed configuration of the injection apparatus of the metal injection molding machine according to the first embodiment.

In the present configuration, to prevent malfunction of the relief valve 20, it is desirable that a valve is inserted in a path for supplying the pressure oil to the relief valve 20. FIG. 3 shows a more detailed configuration of the injection apparatus of the metal injection molding machine according to the first embodiment. As shown in FIG. 3, a solenoid valve 21 (also referred to as a third valve) is inserted in the path between the front chamber 11A and the relief valve 20. A control unit 30 capable of monitoring the pressure of the hydraulic oil in the front chamber 11A is provided, and the control unit 30 controls opening and closing of the solenoid valve 21 in response to the monitoring result.

Next, injection molding by the injection apparatus 100 will be described. The injection molding mainly includes the measuring process, the injection process, and the pressure holding process. Each process will be described below.

The measuring process is a process of measuring the material to be filled into the cavity. In this process, solid molding material is fed from the hopper 3 into the heating barrel 1, and the screw 2 is driven rearward in the axial direction (+X-direction) by the injection hydraulic cylinder 9 while being rotationally driven by the motor 8. Thus, the material is sent to the front of the screw 2 in a molten state inside the heating barrel 1. By measuring the amount of movement of the screw 2, the material fed into the heating barrel 1 can be measured.

The injection process is a process of filling material into the cavity 7. In the injection process, when the measured value reaches a predetermined value, the screw 2 is driven forward in the axial direction by supplying the pressure oil to the injection hydraulic cylinder 9, and the measured molten material is injected from the nozzle 5 into the cavity 7 of the mold 6. In a case of injection-molding of alloy material, if the molten material is not injected at a relatively high speed, the molten metal is rapidly cooled and the filling of the cavity 7 becomes insufficient. Therefore, in general injection molding for metallic material, the accumulator 13 is used as a source providing the pressure oil to the injection hydraulic cylinder 9, and the screw 2 is driven at a high speed (e.g., 1 to 5 m/s) in the axial direction to inject the molten material.

The pressure holding process is a process of applying the pressure to the material filled in the cavity 7 by keeping the pressure applied to the material remaining in the heating barrel 1 in order to compensate for shrinkage caused by cooling of the material after the injection of the material has been completed. Thereafter, the material in the cavity 7 is cooled while applying the pressure to the material. Thus, the material can be molded into a desired shape of the cavity 7.

Figure 4A:
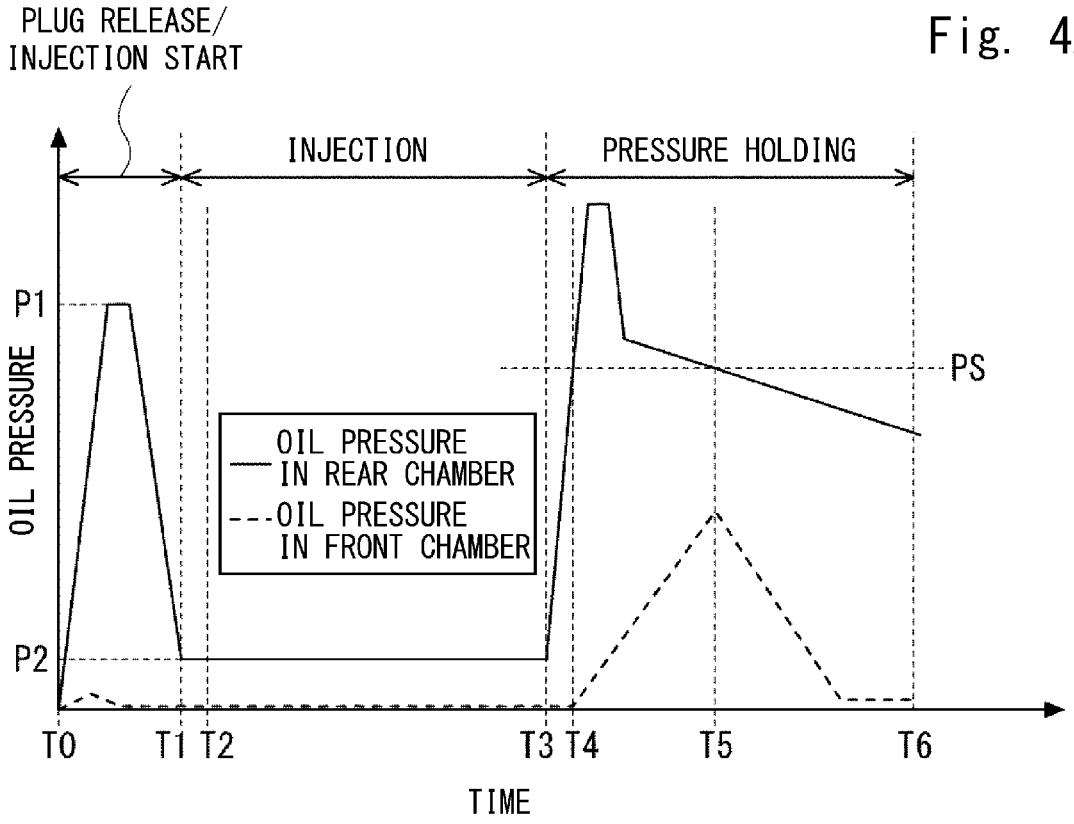
FIG. 4A shows oil pressure in an injection process and a pressure holding process.
Figure 4B:
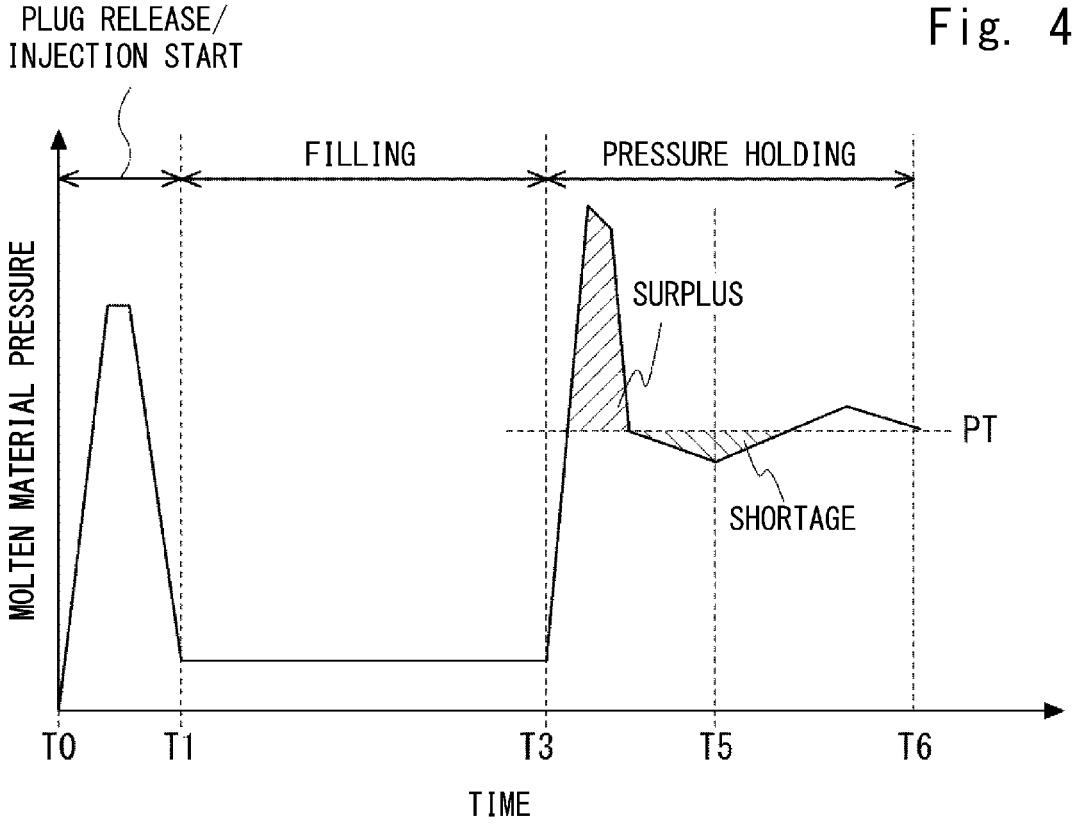
FIG. 4B shows molten material pressure in the injection process and the pressure holding process.

Hereinafter, operations in the injection process and the pressure holding process according to the present embodiment will be specifically described. FIGS. 4A and 4B show oil pressure and molten material pressure in the injection process and the pressure holding process, respectively. The FIG. 4A shows the pressure of the hydraulic oil in the front chamber 11A and the pressure of the hydraulic oil in the rear chamber 11B. The FIG. 4B shows the molten material pressure.

In the present embodiment, when the hydraulic oil is supplied from the accumulator 13 to the front chamber 11A of the injection hydraulic cylinder 9 in the injection process, the pressure of the hydraulic oil in the front chamber 11A starts to increase (Timing T0).

When the hydraulic oil in the front chamber 11A reaches a certain pressure (Pressure P1 in FIG. 4A), a so-called plug (also referred to as cold plug) is released, the pressure of the hydraulic oil in the front chamber 11A starts to decrease, and the injection piston 10 starts to advance in the injection direction (−X-direction). Thereafter, the pressure of the hydraulic oil in the front chamber 11A is kept at a predetermined pressure (Pressure P2 in FIG. 4A) by supplying the pressure oil through the flow control valve 14 (Servo valve) (After Timing T1). On the other hand, since the hydraulic oil in the rear chamber 11B is discharged from the oil discharge port 18 as the injection piston 10 advances, the hydraulic oil in the rear chamber 11B becomes low pressure.

As described above, the molten material pressure P is the value expressed by the following expression, where the oil pressure in the front chamber 11A is $P_{11A}$, the area of the surface of the injection piston 10 on the front chamber 11A side to which the oil pressure is applied is $S_{11A}$, the oil pressure in the rear chamber 11B is $P_{11B}$, the area of the surface of the injection piston 10 on the rear chamber 11B side to which the oil pressure is applied is $S_{11B}$, and the area of the cross-section of the cylinder is Sc.

$$P=(P_{11A}*S_{11A}-P_{11B}*S_{11B})/Sc$$

Therefore, the molten material pressure steeply increases after the injection process starts, decreases when the cold plug is released (Timings T0 to T1), and becomes a constant pressure (After Timing T1) during the filling.

Thereafter, after the pressure of the hydraulic oil in the front chamber 11A becomes lower than the predetermined value, the solenoid valve 21, which has been previously closed, is opened (Timing T2). The reason why the solenoid valve 21 is closed in the initial state and the solenoid valve 21 is opened after the cold plug is released is to prevent the relief valve 20 from opening too early. As described later, since the relief valve 20 is opened and closed to adjust the pressure, it is required to be opened and closed from the latter half of the injection process to the pressure holding process. However, after the injection process starts, the pressure of the hydraulic oil in the front chamber 11A becomes high once before the cold plug is released, and then becomes low after the cold plug is released. At this time, if the pressure of the hydraulic oil in the front chamber 11A becomes higher than a predetermined opening pressure PS (also referred to as a first threshold value) of the relief valve 20 before the cold plug is released, the relief valve 20 opens at an undesired timing. Therefore, in the present configuration, the solenoid valve 21 is provided between the front chamber 11A and the relief valve 20, the solenoid valve 21 is closed from the start of the operation of the injection apparatus until the pressure of the hydraulic oil in the front chamber 11A decreases through the release of the cold plug, and, thereby preventing the relief valve 20 from opening at the undesired and premature timing. Further, by opening the solenoid valve 21 after the pressure of the hydraulic oil in the front chamber 11A decreases, the relief valve 20 can be opened and closed at a desired timing.

Thereafter, when the filling of the molten material to the inside of the mold is completed, then the injection piston 10 is braked by the return action. Accordingly, the pressure of the hydraulic oil in the front chamber 11A temporarily and rapidly increases due to the inertia caused by the advance of the injection piston 10 (Timing T3). However, since the hydraulic oil in the rear chamber 11B is discharged from the oil discharge port 18 through the flow control valve 16, the hydraulic oil in the rear chamber 11B is kept at low pressure.

When the pressure of the hydraulic oil in the front chamber 11A increases and becomes higher than the predetermined opening pressure PS of the relief valve 20, the relief valve 20 opens. After the relief valve 20 has been opened, the pressure of the hydraulic oil in the front chamber 11A is applied to the flow control valve 16, and the flow control valve 16 is closed. Thus, the discharge of the hydraulic oil in the rear chamber 11B from the oil discharge port 18 stops, and the pressure of the hydraulic oil in the rear chamber 11B starts to increase (Timing T4). Since the influence of the inertia of the injection piston 10 is temporary, the pressure of the hydraulic oil in the front chamber 11A starts to decrease after reaching the peak. As a result, the molten material pressure is kept near a target pressure PT after being lowered.

Thereafter, when the pressure of the hydraulic oil in the front chamber 11A becomes lower than the predetermined opening pressure PS (First threshold value) of the relief valve 20, the relief valve 20 is closed (Timing T5). After the relief valve 20 has been closed, the pressure of the hydraulic oil in the front chamber 11A is not applied to the flow control valve 16, and the flow control valve 16 is opened. Thus, the hydraulic oil in the rear chamber 11B is discharged from the oil discharge port 18, so that the pressure of the hydraulic oil in the rear chamber 11B decreases. Thus, the molten material pressure is continuously kept near the target pressure PT.

As described above, although the pressure of the molten material temporarily steeply increases after the timing T3 and the surplus is temporarily generated in the pressure, the pressure can be kept approximately in the vicinity of the target pressure PT until the pressure holding process is completed (Timing T6) while the slight shortage or surplus is generated with respect to the predetermined opening pressure PS thereafter.

As described above, according to the present configuration, the molten material pressure in the pressure holding process can be adjusted at the opening/closing timing of the relief valve, and as a result, an excessive increase in the molten material pressure can be suppressed.

Figure 5A:
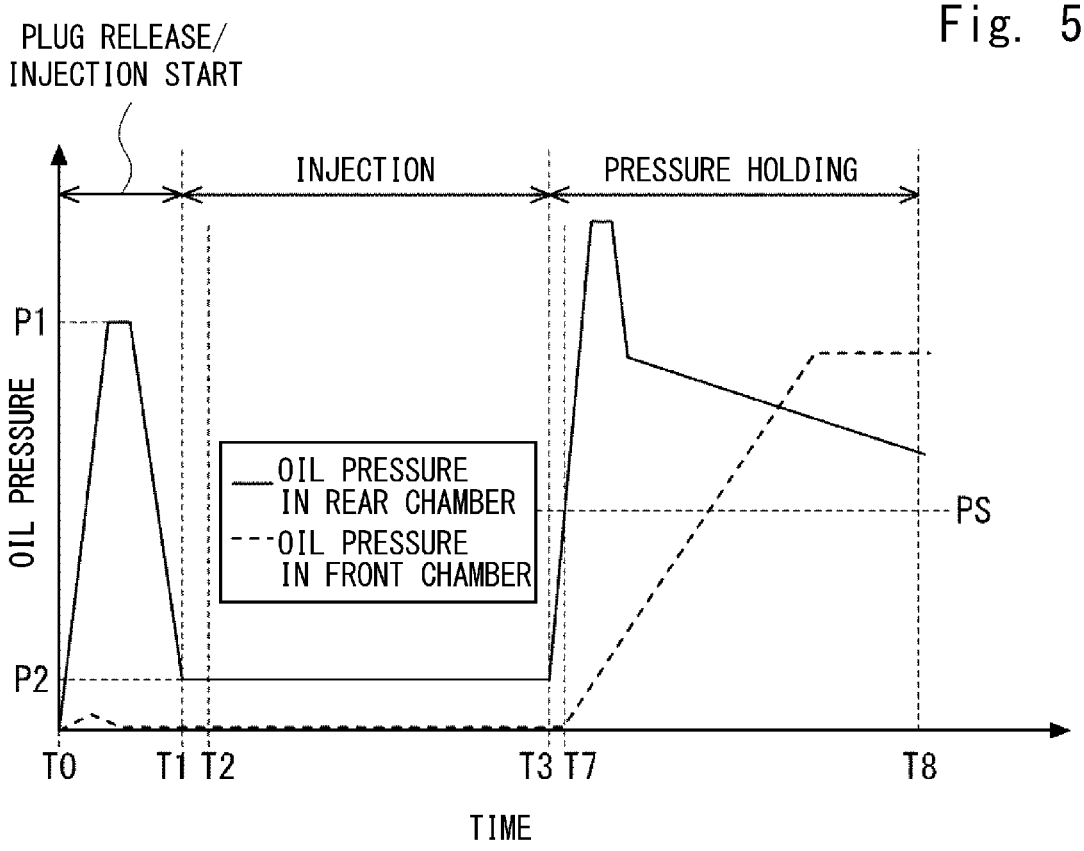
FIG. 5A shows oil pressure when a predetermined opening pressure of a relief valve is set to a lower value.
Figure 5B:
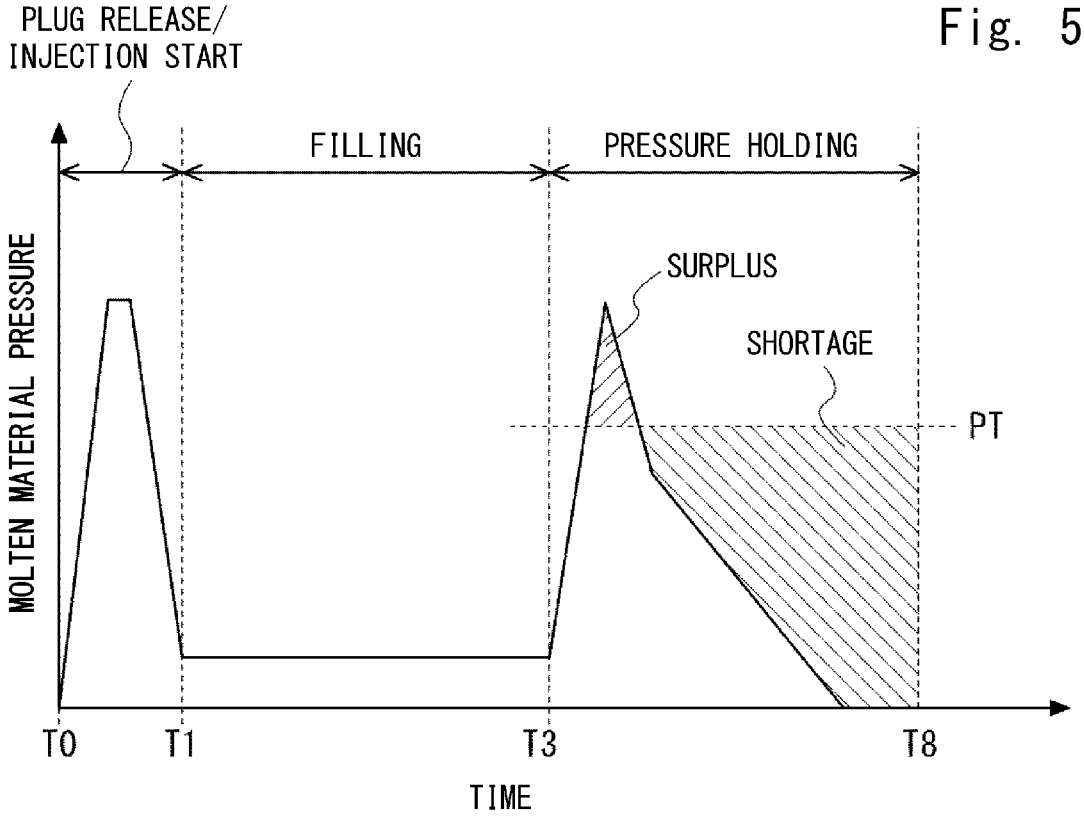
FIG. 5B shows molten material pressure when the predetermined opening pressure of the relief valve is set to the lower value.

By appropriately setting the predetermined opening pressure of the relief valve, it is possible to control the behavior of the molten material pressure in the pressure holding process. FIGS. 5A and 5B show oil pressure and molten material pressure when the predetermined opening pressure of the relief valve is set to a lower value, respectively.

Since the period from the start of the process (Timing T0) to the completion of the filling of the molten material (Timing T3) is the same as in the case of FIGS. 4A and 4B, operations after the completion of the filling will be described.

In this example, the predetermined opening pressure PS of the relief valve 20 is lower than that in FIG. 4A. Therefore, the relief valve opens earlier as compared with the case of FIG. 4A (Timing T7). After the relief valve 20 has been opened, the pressure of the hydraulic oil in the front chamber 11A is applied to the flow control valve 16, and the flow control valve 16 is closed early. Thus, the discharge of the hydraulic oil in the rear chamber 11B from the oil discharge port 18 stops, and the pressure of the hydraulic oil in the rear chamber 11B starts to increase. As a result, the molten material pressure starts to decrease earlier as compared with the case of FIG. 4B. Therefore, the peak value of the molten material pressure is lower than that in FIG. 4B. Thus, the increase in the molten material pressure is further suppressed.

Thereafter, although the pressure of the hydraulic oil in the front chamber 11A decreases, since the pressure is still higher than the predetermined opening pressure PS of the relief valve 20, solidification is completed while the relief valve 20 remains open (Timing T8). In this example, the excess region indicating a state in which the molten material pressure is higher than the target pressure PT is smaller than that shown in FIG. 4B, and it is understood that the increase in the pressure of the molten material is further suppressed. In addition, since the shortage area in which the molten material pressure becomes smaller than the target pressure PT greatly increases, it can be understood that the period of shortage of the target pressure PT increases.

As described above, when the predetermined opening value of the relief valve 20 is set to a low value, although the period in which the target pressure PT is insufficient increases, the material having a small shrinkage rate after filling and the material having a short time to cure can be suitably applied. In this case, it is also possible to further suppress the occurrence of burrs and the load on the mold.

As described above, in the present configuration, by suitably setting the predetermined opening value of the relief valve in accordance with the material of the molten material to be filled in the mold, the pressure in the pressure holding process can be adjusted, and a desired pressure holding process can be achieved.

Other Embodiments

The present disclosure is not limited to the above-described embodiments and can be appropriately changed without departing from the scope of the present disclosure. For example, the end of the path for supplying hydraulic oil to the relief valve 20 and the solenoid valve 21 have been connected between the oil supply port 15 and the flow control valve 14 in the above embodiment, and, however, this is merely an example. Another opening may be disposed in the housing 9A, and the hydraulic oil in the front chamber 11A may be supplied to the relief valve 20 and the solenoid valve 21 through the opening.

It should be appreciated that various valves can be used as each of the flow control valve 16, the relief valve 20, and the solenoid valve 21 as long as they can perform similar functions.

In the above-described embodiment, an example in which the metal is used as the material to be injected has been described, and, however, this is merely an example. It should be appreciated that the configuration according to the above-described embodiment may be applied to an injection molding machine for injecting other materials such as resin.

Such variations are not to be registered as a departure from the spirit and scope of the disclosure, and all such modifications as would be impossible to one skilled in the art are intended for inclusion within the scope of the following claims.

What is claimed is:

1. An injection apparatus comprising:

an injection piston configured to be capable of being driven along an axial direction of a heating barrel, the injection piston being connected to a screw provided in the heating barrel to be rotatable and driving the screw along the axial direction;

an injection hydraulic cylinder configured to drive the injection piston housed therein in the axial direction by pressure of hydraulic oil, inside of the injection hydraulic cylinder being partitioned into a first chamber in which pressure oil is supplied to drive the injection piston and a second chamber from which hydraulic oil is discharged;

an oil discharge port provided in the injection hydraulic cylinder and configured to discharge the hydraulic oil from the second chamber;

a first valve inserted in a path for discharging the hydraulic oil discharged from the second chamber through the oil discharge port; and a second valve configured to be supplied with a part of the hydraulic oil supplied to the first chamber and to open when the pressure of the provided oil is higher than a first threshold value, wherein the first valve is configured to close when the pressure of the hydraulic oil supplied through the second valve is applied to the first valve, an oil supply port is provided in the injection hydraulic cylinder and configured to supply the first chamber with the hydraulic oil, and the second valve is provided between the oil supply port and the first valve.

2. The injection apparatus according to claim 1, further comprising a third valve inserted in a path for supplying the second valve with the hydraulic oil and configured to open after a predetermined period from the start of supplying the hydraulic oil to the first chamber.

3. The injection apparatus according to claim 2, wherein the third valve opens after a cold plug has been released after the supply of hydraulic oil to the first chamber has started.

4. The injection apparatus according to claim 1, wherein the first threshold value can be set according to a material to be fed into the heating barrel.

* * * * *